United States Patent [19]

Anderson

[11] Patent Number: 4,970,790

[45] Date of Patent: Nov. 20, 1990

[54] BAS-RELIEF CARVING PLATE ASSEMBLY

[76] Inventor: Martin L. Anderson, Rte. 3, Box 60, Maple Lake, Minn. 55368

[21] Appl. No.: 503,992

[22] Filed: Apr. 4, 1990

[51] Int. Cl.[5] ..... B26B 13/00

[52] U.S. Cl. ..... 30/231; 30/296.1

[58] Field of Search ..... 30/210, 216, 228, 231, 30/273, 275, 296.1, 122, 500; 83/425 CC

[56] References Cited

U.S. PATENT DOCUMENTS

| | | | |
|---|---|---|---|
| 2,394,452 | 2/1946 | Howard | 30/296.1 X |
| 2,765,796 | 10/1956 | Guenther | 30/231 X |
| 3,478,786 | 11/1969 | Hendrickson | 30/275 X |
| 4,033,035 | 7/1977 | Trimmer | 30/122 |

*Primary Examiner*—Douglas D. Watts

*Attorney, Agent, or Firm*—Haugen and Nikolai

[57] ABSTRACT

A tool holder for facilitating the carving of carpet fibers for producing a decorative, sculpted surface includes a rigid, polygonal-shaped base plate having a central opening formed therein through which the cutting head of a carpet carver may pass. The plate includes a plurality of handles disposed about its perimeter and mounted on the upper surface thereof is a support member to which a tool clamp can be attached at any one of a plurality of different height elevations thus providing for a depth-of-cut adjustment. The tool clamping fixture includes a central opening the size of which can be adjusted to loosely or tightly grip a carpet carver. The clamping fixture is pivotally secured to the support permitting further adjustment of the depth of cut as well as the angle of intersection of the cutting head with the carpet surface.

6 Claims, 2 Drawing Sheets

BAS-RELIEF CARVING PLATE ASSEMBLY

BACKGROUND OF THE INVENTION

I. Field of the Invention: This invention relates generally to apparatus for sculpting a pattern into the surface of plush carpeting, and more particularly to a tool assembly that permits more accurate control over the angle and depth of cut.

II. Discussion of the Prior Art: Even though commercially-available carpeting comes in a variety of colors, fibers (natural and man-made) and surface patterns and designs, there is a demand for custom designing of carpeting. For example, a company may wish to emblazon a carpet in a reception area with its company logo. Custom weaving or fabrication at a carpet factory tends to be prohibitively expensive because of the limited run for servicing a single customer. The same effect can be achieved by cutting out a desired pattern at a location of interest in the major piece of carpeting and then in-laying a second piece of carpeting of a contrasting color into the opening and then stitching or gluing the carpet backing so that the carpet and the in-lay are permanently joined.

Alternatively, a consumer may wish to have an otherwise planar surface of a carpet sculpted to provide a desired pattern formed in bas-relief in the surface thereof. In shearing and carving patterns in carpeting, it has been the practice to employ air-driven or electrically-powered clippers having first and second blade members, each with a plurality of sharpened teeth. The blade members are made to move laterally and reciprocally relative to one another at high speeds. Such carvers or clippers are not unlike hair clippers commonly used by barbers.

When attempting to cut intricate patterns or to form bas-relief sculpted patterns on the surface of a carpet, operator fatigue becomes a problem. After a short period of time, muscle strain makes it difficult to hold the tool steady while working on the carpet. As a result, undesirable variations in depth of cut or its locations occur which may require rework and/or replacement of the entire carpet if the results do not meet the customer's approval.

OBJECTS

It is accordingly a principal object of the present invention to provide an improved apparatus for facilitating the cutting of patterns in the face of plush carpet fibers.

Another object of the invention is to provide an improved tool for holding a carpet carver for maintaining a desired depth of cut and angle of cut as the tool is made to traverse a predetermined pattern on the face of a carpet.

Yet another object of the invention is to provide a carpet carving tool holding fixture which can be readily manipulated and moved over the surface of a carpet while the carver clips the carpet fibers to a uniform depth where both the depth of cut an the angle of cut can be readily adjusted and then maintained until again changed.

SUMMARY OF THE INVENTION

The foregoing objects are achieved in accordance with this invention by providing a rigid, planar, polygonal-shaped base plate having a top surface, a bottom surface and a central aperture formed through the thickness dimension of the plate. The perimeter of the plate is downwardly and inwardly beveled at a predetermined angle, e.g., 50 degrees, and a plurality of handle members are attached to the top surface of the plate allowing the user to easily move the plate over the surface of a carpet being worked on. Because of the beveled edges, there is no tendency for the plate to dig into the carpet fibers and snag or catch.

In accordance with a first embodiment, a support member is attached to the base plate proximate the central aperture and it projects vertically upward from the top surface of the plate. The support member includes a plurality of holes formed therethrough the axis of these holes being parallel to the plane of the base plate. A tool clamping fixture is bolted to the support member by a single bolt passing through a selected one of the holes, the bolt serving as an axis of rotation for the clamping fixture relative to the support member. The tool clamping fixture includes a tool receiving opening therethrough, the size of which can be reduced to firmly grip a carving tool inserted through that opening. By appropriately positioning the carpet carving tool within the clamping fixture, adjusting the height of the fixture relative to the plane of the base plate and by rotating the clamping fixture relative to the support member, the shearing tool becomes infinitely adjustable for cut angle and depth of cut. By making the base plate transparent, the user can view any pattern to be followed and previously marked out on the carpet, thus facilitating the appropriate manipulation of the tool holder to trace out that pattern.

In accordance with a second embodiment, two support members are affixed to the top surface of the plate and each supports a tool-clamping fixture of the type described above. Each of the tool-clamping fixtures is provided with a clipper-type carving tool which is so arranged that by appropriate rotation of the tool within its clamping fixture and by proper pivoting of the clamping fixture relative to its support member, the cutting blades on the two carving tools can be made to intersect at an appropriate depth within the carpet pile which allows a V-shaped notch to be cut into the carpet surface thus obviating the need for multiple passes as would be required when only a single cutting tool is employed.

DESCRIPTION OF THE DRAWINGS

The foregoing features and advantages of the invention will become apparent to those skilled in the art from the following detailed description of the preferred embodiment, especially when considered in conjunction with the accompanying drawings in which like numerals in the several views refer to corresponding parts.

DESCRIPTION OF THE PREFERRED EMBODIMENT

Figure 1:
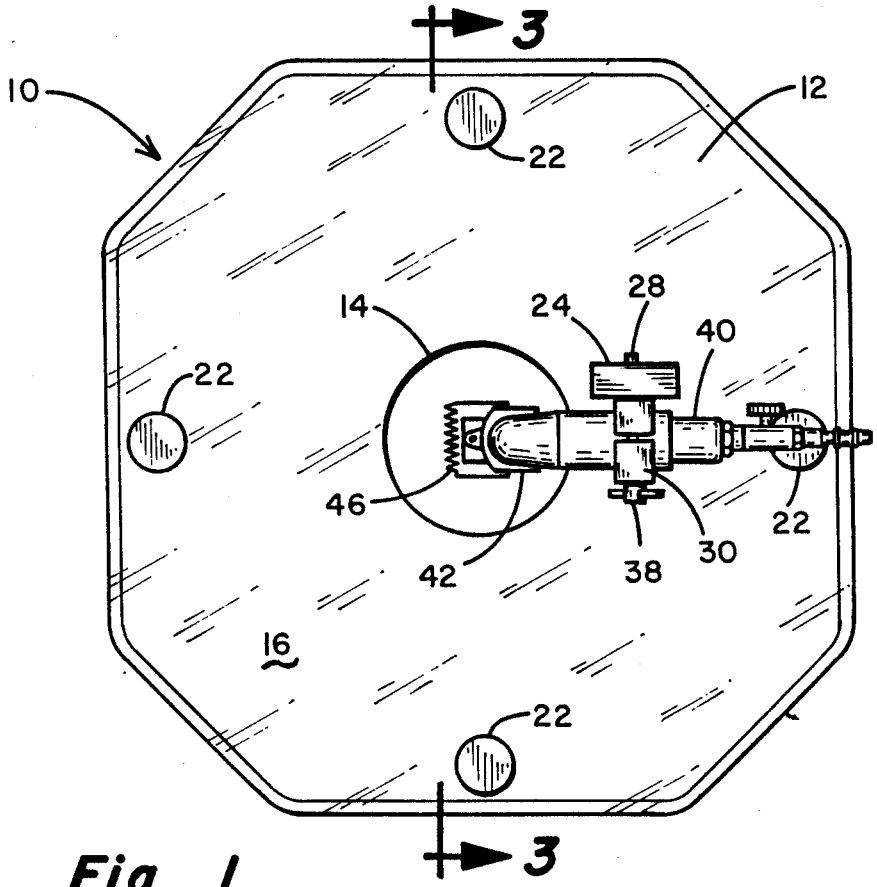
FIG. 1 is a top plan view of the bas-relief tool in accordance with a first embodiment of the present invention.

Referring first to FIG. 1, there is indicated generally by numeral 10 a carver holding fixture for facilitating the formation of bas-relief designs in the face of a floor carpet. It is seen to comprise a generally planar, polygonal plate member 12 here shown as an octagon, and having a central opening 14 formed therein. The plate member may be about 24" on the diagonal and is preferably formed from a transparent plastic, such as Lexan®. It includes a top surface 16 and a bottom surface 18. Its edges are beveled, as at 20, preferably at an angle of approximately 50 degrees, the taper being inwardly and downwardly from the top surface 16 to the undersurface 18.

Affixed at regularly spaced intervals and projecting upwardly from the top surface 16 of the plate 12 are a plurality of knobs as at 22 which serve as handles which may be grasped by the operator in steering the assembly over the carpet surface.

Figure 2:
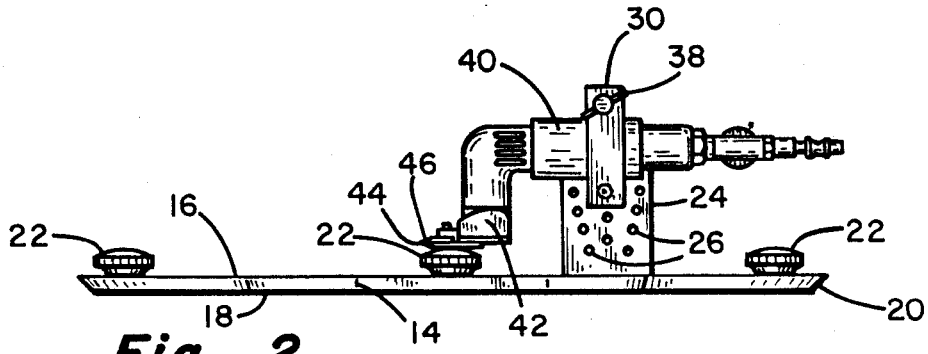
FIG. 2 is a right side view of the device of FIG. 1.
Figure 3:
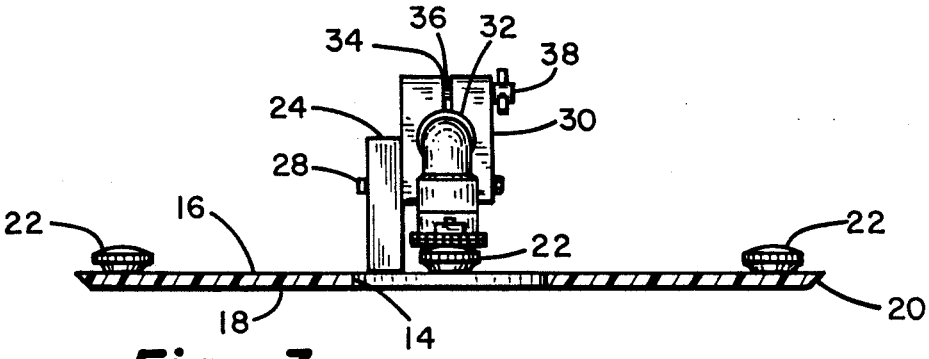
FIG. 3 is a front view of the device of FIG. 1.

Also secured to the upper surface 16 of the plate 12 is a support member 24 which may comprise a block of a suitable material having a pattern of apertures, as at 26 (FIG. 2), extending through the thickness dimension thereof. The block 24 may be attached to the plate by screws or, alternatively, by an appropriate adhesive capable of forming a strong bond between the lower edge of the support member 24 and the top surface 12 of the plate.

Pivotally secured to the upwardly projecting support member 2 by a bolt 28 passing through a selected one of the apertures 26 is a clamping fixture 30 having a tool receiving opening 32 formed through its thickness dimension. A slot 34 is cut through the material comprising the clamping member 30 from its top surface to the tool-receiving opening 32. A horizontal bore is then formed through the clamping fixture 30, proximate the upper end thereof. The bore receives a threaded bolt 36 and a wing nut 38 is attached thereto. By tightening the wing nut, the diameter of the tool receiving opening 32 can be reduced.

Fitted through the tool-receiving opening 32 of the clamping fixture 30 is an air or electrically operated carver, indicated generally by numeral 40. Such a carver is commercially available through National Carpet Equipment, Inc. of Maple Grove, Minnesota, the assignee of the present application. As can be seen from the drawings, the carver 40 has a generally cylindrical body whose diameter is slightly less than the diameter of the tool-receiving bore 32 formed in the clamping fixture 30 and when that cylindrical body is inserted through the tool-receiving opening and the thumbscrew 38 is tightened, the tool will be clamped.

Extending downwardly from the tubular body of the carver is a cutting head 42 which includes an eccentric mechanism for imparting relative reciprocal motion in the lateral direction between a stationary lower cutting element 44 and an upper movable cutting blade element 46. The carver 40 closely resembles a type of electric or air-driven clipper used in shearing hair from animals.

In use, the plate will be set on the carpet to be trimmed with the bottom surface 18 engaging the carpet pile. The operator will then select the desired depth-of-cut by choosing the particular aperture 26 through which the bolt 28 used to affix the clamping fixture 30 to the support 24 will pass. In that only a single bolt is used to secure the clamping fixture 30 to the support 24, the clamping fixture may be pivoted about the bolt 28 to swing the clipper blades 44–46 through the opening 14 in the base plate and into the carpet fibers to be trimmed. Now, when the operator grasps one of the several handles 22 in each hand, he may accurately move the assembly 10 across the carpeting as the power clipper 40 does its job. Because of the angle at which the edges 20 are beveled, the leading edge of the plate will not tend to dig into the carpet fibers to snap or catch. Hence, the plate can be easily made to traverse the surface of the carpeting while the operator steers the assembly over the prearranged pattern.

When it is desired to cut a V-groove into the carpet, the tool 40 may be rotated about its own longitudinal axis in the tool-receiving opening 32 of the clamping member 30 until the cutting blades 44–46 are at the desired angle. Then, by tightening the thumb nut 38, the carving tool 40 will be maintained locked in that desired angular orientation. The operator will make a first pass along a predetermined path so as to cut one side of the V-shaped notch. Once that has been accomplished, the operator can adjust the positioning of the cutting tool within its clamping member so that the opposed blade edge will now engage the carpet surface and then adjust the angle so that when the first path is again traversed, the second side of the V-shaped notch will be created.

Figure 4:
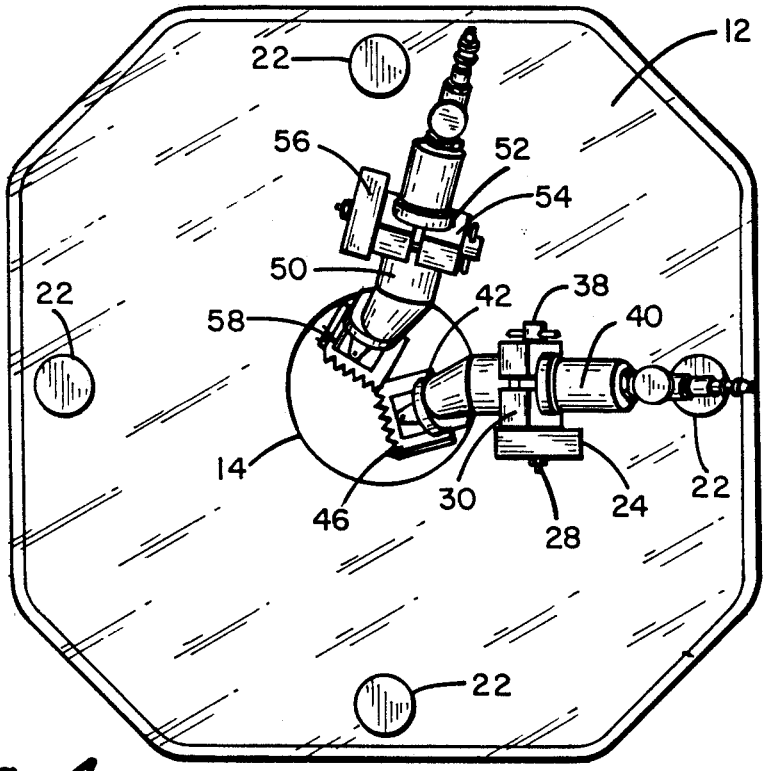
FIG. 4 is a top plan view of the bas-relief tool in accordance with a second embodiment of the present invention.
Figure 5:
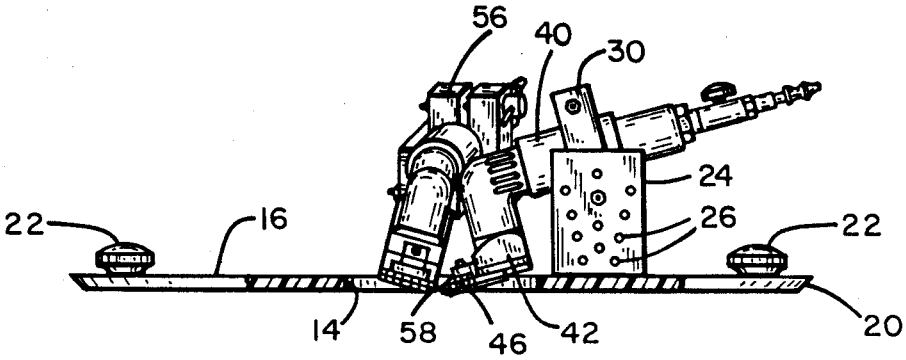
FIG. 5 is a front view of the device of FIG. 4.

While the embodiment of FIG. 1 may be used in the manner just described to create a V-shaped notch, it has been found more expedient to create such a notch with only a single pass of the bas-relief plate over the area of the carpet to be so trimmed. So accomplish end, and as shown in FIGS. 4 and 5, in addition to the carver 40 mounted in its clamping fixture 30 and rotatably supported on support member 24, the assembly further includes a second carver 50 passing through a tool-receiving opening 52 formed in a clamping member 54 and affixed to a support member 56 in substantially identical fashion as the carver 40 is supported relative to the upper surface 16 of the bas-relief plate 12. The support member 56 is angularly displaced from the support member 24 but positioned so that the cutting assembly 58 of the carver 50 will be positioned within the circular opening 14 of the bas-relief plate and closely adjacent the cutting blades 46 of the carver 40. As can be best seen in the view of FIG. 5, because of the degrees of freedom allowed by the ability of the carvers 40 and 50 to be rotated within their respective clamping members 30 and 54 and the ability of the clamping member to be pivoted relative to the support members 24 and 56, the cutting blades 46 and 58 may be inclined relative to one another so that as the bas-relief plate is moved over the surface of the carpet, the cutters will simultaneously create the two inclined surfaces of a V-groove. This leads to a more uniform appearance and less likelihood of an irregular cut than when two passes with a single carver are required to create the V-groove.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. Apparatus for sculpting plush carpet to produce decorative patterns therein comprising:

(a) a rigid, planar polygonal-shaped base plate having a top surface, a bottom surface and a central aperture formed through the thickness dimension of said plate;

(b) a plurality of handle members attached to said top surface proximate the outer perimeter of said base plate;

(c) support means attached to said base plate proximate said central aperture and projecting vertically upward from said top surface; and (d) clamping fixture means pivotally secured to said support means for rotation about an axis extending parallel to the plane of said base plate, said clamping fixture means including a tool receiving opening, the size of which can be varied to loosely or tightly grip a tool when inserted therethrough.

2. The apparatus as in claim 1 and further including a carpet carver having a generally cylindrically body insertable into said tool receiving opening of said clamping fixture means and a shearing head, including a first blade member non-movably affixed to said body and a second blade member juxtaposed to said first blade member and laterally, reciprocally movable relative thereto, said shearing head being insertable through said central aperture.

3. The apparatus as in claim 2 wherein said support means permits adjustment of the vertical location of said axis.

4. The apparatus as in claim 3 wherein said support means includes a plurality of apertures extending therethrough at differing height elevations relative to said base plate, said clamping fixture means being secured to said support means by a bolt passing through a selected one of said plurality of apertures, said bolt defining said axis whereby the depth of penetration of said blade members through said central aperture can be selectively set.

5. The apparatus as in claim 1 wherein said base plate is made of a transparent material to allow viewing of said carpet as it is being sculpted.

6. The apparatus as in claim 1 wherein the edges of said polygonal-shaped base plate are downwardly and inwardly beveled from said top surface to said bottom surface to facilitate movement of said base plate over the face of a carpet to be sculpted without catching.

* * * * *